US011969848B2

(12) United States Patent
Gacoin et al.

(10) Patent No.: US 11,969,848 B2
(45) Date of Patent: Apr. 30, 2024

(54) OPTICAL-GRADE SURFACING TOOL

(71) Applicant: ESSILOR INTERNATIONAL, Charenton-le-Pont (FR)

(72) Inventors: Eric Gacoin, Charenton-le-Pont (FR); Pierre Kress, Charenton-le-Pont (FR); Jean Stephane, Charenton-le-Pont (FR); Jonathan Saulny, Charenton-le-Pont (FR)

(73) Assignee: Essilor International, Charenton-le-pont (FR)

( * ) Notice: Subject to any disclaimer, the term of this patent is extended or adjusted under 35 U.S.C. 154(b) by 1323 days.

(21) Appl. No.: 16/467,867

(22) PCT Filed: Oct. 27, 2017

(86) PCT No.: PCT/FR2017/052965
§ 371 (c)(1),
(2) Date: Jun. 7, 2019

(87) PCT Pub. No.: WO2018/104601
PCT Pub. Date: Jun. 14, 2018

(65) Prior Publication Data

US 2019/0344396 A1 Nov. 14, 2019

(30) Foreign Application Priority Data

Dec. 9, 2016 (FR) ..... 1662259

(51) Int. Cl.
*B24D 13/14* (2006.01)
*B24B 7/24* (2006.01)
*B24B 13/01* (2006.01)

(52) U.S. Cl.
CPC ..... *B24B 13/012* (2013.01); *B24B 7/24* (2013.01); *B24D 13/142* (2013.01)

(58) Field of Classification Search
CPC .... B24D 13/14; B24D 13/142; B24D 13/147; B24B 7/24; B24B 13/0006;
(Continued)

(56) References Cited

U.S. PATENT DOCUMENTS 3,583,111 A * 6/1971 Volk ..... B24B 13/01 451/490
5,403,231 A * 4/1995 2 ..... B24B 23/02 451/490
(Continued)

FOREIGN PATENT DOCUMENTS

DE 3416186 A1 1/1985
FR 2834662 A1 7/2003
(Continued)

OTHER PUBLICATIONS

International Search Report, dated Feb. 12, 2018, from corresponding PCT application No. PCT/FR2017/052965.

*Primary Examiner* — Eileen P Morgan
(74) *Attorney, Agent, or Firm* — NIXON & VANDERHYE

(57) ABSTRACT

The tool includes a base including a rigid carrier and a flexible collar encircling the rigid carrier; an elastically compressible interface; and a flexible buffer including a central portion that is located in line with the rigid carrier and a peripheral portion that is located transversely therebeyond. This peripheral portion is connected to the carrier exclusively via the interface and via the collar, wherein the collar is configured so that the tool is elastically deformable between a rest position that it adopts in the absence of stress and a reference position in which the transverse end second surface of the flexible buffer is pressed against a reference surface that is spherical and of radius included between 40 mm and 1500 mm.

17 Claims, 5 Drawing Sheets

(58) Field of Classification Search
CPC ..... B24B 13/0012; B24B 13/0018; B24B 13/0025; B24B 13/01; B24B 13/012; B24B 37/20; B24B 37/22
USPC .... 451/42, 59, 277, 495, 508, 514, 913, 921
See application file for complete search history.

(56) References Cited

U.S. PATENT DOCUMENTS

| | | | | |
|---|---|---|---|---|
| 6,945,849 | B2 * | 9/2005 | Miyazawa | B24D 13/14 451/504 |
| 7,033,261 | B2 | 4/2006 | Huguet | |
| 7,223,164 | B2 | 5/2007 | Bernard et al. | |
| 7,559,829 | B2 * | 7/2009 | Stephane | B24B 13/02 451/514 |
| 8,408,976 | B2 | 4/2013 | Stephane | |
| 8,475,237 | B2 | 7/2013 | Meynen | |
| 8,668,557 | B2 * | 3/2014 | Batard | B24D 9/08 451/512 |
| 8,894,471 | B2 * | 11/2014 | Batard | B24B 13/00 451/512 |
| 2004/0043710 | A1 * | 3/2004 | Miyazawa | B24D 13/147 451/42 |
| 2005/0003742 | A1 * | 1/2005 | Miyazawa | B24B 13/012 451/41 |
| 2005/0101235 | A1 | 5/2005 | Huguet | |
| 2006/0099889 | A1 * | 5/2006 | Tabata | B24B 13/02 451/41 |
| 2006/0154581 | A1 * | 7/2006 | Bernard | B24B 13/02 451/495 |
| 2008/0171502 | A1 | 7/2008 | Stephane et al. | |
| 2010/0178858 | A1 | 7/2010 | Stephane | |
| 2011/0136415 | A1 | 6/2011 | Batard et al. | |
| 2011/0136416 | A1 | 6/2011 | Meynen | |
| 2012/0231713 | A1 | 9/2012 | Batard et al. | |
| 2013/0052918 | A1 * | 2/2013 | Yajima | B24B 13/02 451/42 |
| 2013/0130599 | A1 * | 5/2013 | Miyazaki | B24B 13/01 451/526 |

FOREIGN PATENT DOCUMENTS

| | | | |
|---|---|---|---|
| FR | 2857610 | A1 | 1/2005 |
| FR | 2900356 | A1 | 11/2007 |
| FR | 2918911 | A1 | 1/2009 |
| FR | 2935627 | A1 | 3/2010 |
| FR | 2935628 | A1 | 3/2010 |
| FR | 2953433 | A1 | 6/2011 |
| GB | 1188381 | A | 4/1970 |
| JP | 2000-317797 | A | 11/2000 |

* cited by examiner

OPTICAL-GRADE SURFACING TOOL

FIELD OF THE INVENTION

The invention relates to optical-grade surfacing for surfaces such as a face of an ophthalmic lens or of a camera lens or of an instrument intended for the observation of far-off objects or even a face of a semiconductor substrate.

By surfacing, what is meant is any operation aiming to modify the finish of a previously generated surface. It is in particular a question of polishing, fining or roughening operations aiming to modify (decrease or increase) the roughness of the surface and/or to decrease the waviness thereof.

PRIOR ART

Those skilled in the art already know about, in particular from Japanese patent application 2000-317797, from French patent application 2 834 662 to which US patent application 2005/0101235 corresponds, from French patent application 2 857 610 to which US patent application 2006/0154581 corresponds, from French patent application 2 900 356 to which US patent application 2008/0171502 corresponds, from French patent application 2 918 911 to which US patent application 2010/0178858 corresponds, from French patent application 2 935 627 to which US patent application 2011/0136416 corresponds, from French patent application 2 935 628 to which US patent application 2011/0136415 corresponds, and from French patent application 2 953 433 to which US patent application 2012/0231713 corresponds, a tool for surfacing an optical surface comprising: a rigid holder having a transverse end surface; an elastically compressible interface attached to the rigid holder and having a first transverse end surface, a second transverse end surface and a lateral surface extending from the periphery of the first end surface to the periphery of the second end surface, said first end surface of the interface being applied against and covering said end surface of the rigid holder; and a flexible buffer able to be applied against the optical surface and that is applied against and at least partially covers the second end surface of the interface opposite and plumb with said end surface of the rigid holder.

To decrease the roughness of the optical surface, the tool is brought into contact therewith while a sufficient pressure is maintained thereon by the tool so that, by deformation of the interface, the buffer matches the shape of the optical surface.

While the optical surface is sprayed with a fluid, it is driven to move relative to the tool in such a way that it is entirely scanned by the latter.

Generally, the optical surface is driven to rotate, the friction between it and the tool being sufficient to conjointly drive the latter to rotate, a variable off-centeredness during the operation ensuring the relative movement and the scan.

The surfacing operation requires an abrasive that may be contained in the buffer or in the fluid.

During surfacing, the elastically compressible interface allows the difference in curvature between the end surface of the holder of the tool and the optical surface to be compensated for.

SUBJECT OF THE INVENTION

The invention aims to provide a surfacing tool that is effective in terms of productivity and of the obtained quality of appearance while remaining simple, convenient and economical to manufacture.

To this end it proposes an optical-grade surfacing tool, comprising:

- a base comprising a rigid holder and a flexible collar encircling said rigid holder, which rigid holder has a transverse end surface, and which collar has a transverse end surface that is located on the same side as the transverse end surface of the rigid holder;
- an elastically compressible interface comprising a first transverse end surface, a second transverse end surface and a lateral surface extending from the periphery of the first transverse end surface to the periphery of the second transverse end surface, the first transverse end surface of the elastically compressible interface being attached to the transverse end surface of the rigid holder and to the transverse end surface of the collar; and
- a flexible buffer having a first transverse end surface that is attached to the second transverse end surface of the elastically compressible interface and a second transverse end surface that is configured to be applied against a surface to be worked, which buffer comprises a central portion that is located plumb with the transverse end surface of the rigid holder and a peripheral portion that is located transversely beyond this transverse end surface;
- characterized in that said peripheral portion is joined to the holder exclusively by said interface and by said collar, which collar is configured so that the tool is elastically deformable between a rest position that it takes in the absence of stress and a reference position in which the second transverse end surface of the flexible buffer is pressed against a reference surface that is spherical and of radius comprised between 40 mm and 1500 mm.

Contrary for example to the surfacing tool known in particular from French patent application 2 900 356 to which US patent application 2008/0171502 corresponds, there are no elastic return means such as a star-shaped part connecting the peripheral portion of the buffer to the holder.

Although this is surprising, it turns out that in fact it is possible to configure the collar, for example as described below, so that the collar is sufficiently elastically deformable that there is no need for such elastic return means.

The elastic character of the deformation of the tool between the rest position and the reference position means that the tool is not permanently deformed, i.e. when the action of pressing the tool against the reference surface ceases the tool returns to its rest position, possibly after a delay of a few seconds.

By virtue of its small number of components, the tool according to the invention is simple, convenient and economical to manufacture.

Furthermore, it is possible to configure the tool according to the invention, for example as explained below, so that the tool has the capacity to exert a relatively uniform pressure on the surface to be worked, this having a favorable effect on the performance in terms of productivity and aspect quality of the surfacing carried out.

According to advantageous features, said collar is configured so that the tool is elastically deformable between said rest position that it takes in the absence of stress and:

- in the case where said surface to be worked is concave, not only a first concave reference position in which the second transverse end surface of the flexible buffer is pressed against a first concave reference surface that is spherical, concave and of radius of 1500 mm but also a second concave reference position in which the second transverse end surface of the flexible buffer is pressed against a second concave reference surface that is spherical, concave and of radius of 40 mm; or in the case where said surface to be worked is convex, not only a first convex reference position in which the second transverse end surface of the flexible buffer is pressed against a first convex reference surface that is spherical, convex and of radius of 40 mm but also a second convex reference position in which the second transverse end surface of the flexible buffer is pressed against a second convex reference surface that is spherical, convex and of radius of 1500 mm.

The tool is thus equally capable of deforming elastically from the rest position to the first reference position as from the rest position to the second reference position, and therefore of deforming elastically in a particularly extensive range of curvatures.

By virtue of the capacity of the tool to deform elastically in a range of curvatures of such extent, an assembly formed by a surfacing machine and by a tool according to the invention may surface most common ophthalmic lenses.

It will be noted in this respect that in contrast, with already known tools, three different models of tools having different curvatures in the rest position are required to be able to surface the same range of curvatures.

The universal character of the tool according to the invention is particularly advantageous in terms of productivity since there is no need to change tool when the curvature of the surface to be worked is changed.

According to advantageous features:

the value of the force applied to the holder coaxially to the tool while the tool is coaxial with the reference surface in order to make the tool pass from the rest position to the reference position is comprised between 30 N and 180 N;

said collar is configured so that the force-to-movement ratio between, on the one hand, the value of the force applied to the holder coaxially to the tool while the tool is coaxial with the reference surface in order to make the tool pass from the rest position to the reference position and, on the other hand, the value of the movement of the holder between the rest position and the reference position is comprised between 3 N/mm and 15 N/mm with a set movement speed of 25 mm/s;

said force-to-movement ratio is comprised between 5 N/mm and 8 N/mm with a set movement speed of 25 mm/s;

the transverse end surface of the collar is flush with the transverse end surface of the holder;

the collar is subdivided into petals;

said petals are subdivided by radially oriented slits;

each petal takes root laterally to said rigid holder;

each petal has a thickness that varies as a function of the distance x from its far end, this thickness being the same for every petal at a given distance x from the far end of the petal;

at each distance x the thickness h(x) of the petal is given by the formula:

$$h(x)^3 = \frac{K}{b(x)}\int_0^x\left(\int_0^x b(x)dx\right)dx$$

with b(x) the width of the petal at the distance x and K a constant;

the width of the petal as a function of the distance x to the far end of the petal is expressible in the form of the polynomial:

$$b(x) = \sum_{i=0}^{n} a_n x^n = a_0 + a_1 x + a_2 x^2 + \ldots + a_n x^n$$

so that at each distance x the thickness of the petal is given by the formula:

$$h(x)^3 = \frac{K}{b(x)}\left(\frac{a_0 x^2}{2} + \frac{a_1 x^3}{6} + \ldots + \frac{a_n x^{n+2}}{(n+1)(n+2)}\right);$$

the petals have the shape of a truncated angular sector so that the width of the petal as a function of the distance x to the far end of the petal is expressible in the form of the polynomial:

$$b(x)=a_0+a_1 x$$

so that at each distance x the thickness of the petal is given by the formula:

$$h(x)^3 = \frac{K}{b(x)}\left(\frac{a_0 x^2}{2} + \frac{a_1 x^3}{6}\right);$$

at each distance x from the far end of the petal, the thickness of the petal is smaller than:

$$h_{MAX} = \frac{R\sigma_{MAX}}{2E}$$

with $\sigma_{MAX}$ being the tensile limit of the material of the petals, E being the elastic modulus of the material of the petals and R being the inverse of the difference in curvature between the rest position and the reference position of the tool; and/or the ratio between the area of the transverse end surface of the collar, i.e. the total area of the surface of the petals, and the area of the corresponding annular surface is comprised between 30 and 80%.

The invention also relates to an assembly comprising a surfacing machine and a tool such as described above, wherein said machine is configured to apply, to the holder of the tool, a preset machine force of constant value, and said tool is configured so that the value of the force applied to the holder coaxially to the tool while the tool is coaxial with the reference surface in order to make the tool pass from the rest position to the reference position is comprised between 85% and 100% of said constant value of the machine force.

BRIEF DESCRIPTION OF THE DRAWINGS

The disclosure of the invention will now continue with a detailed description of embodiments thereof, given below by way of illustration and nonlimiting example, and with reference to the appended drawings. In the latter.

DETAILED DESCRIPTION OF EXEMPLARY EMBODIMENTS

Figure 1:
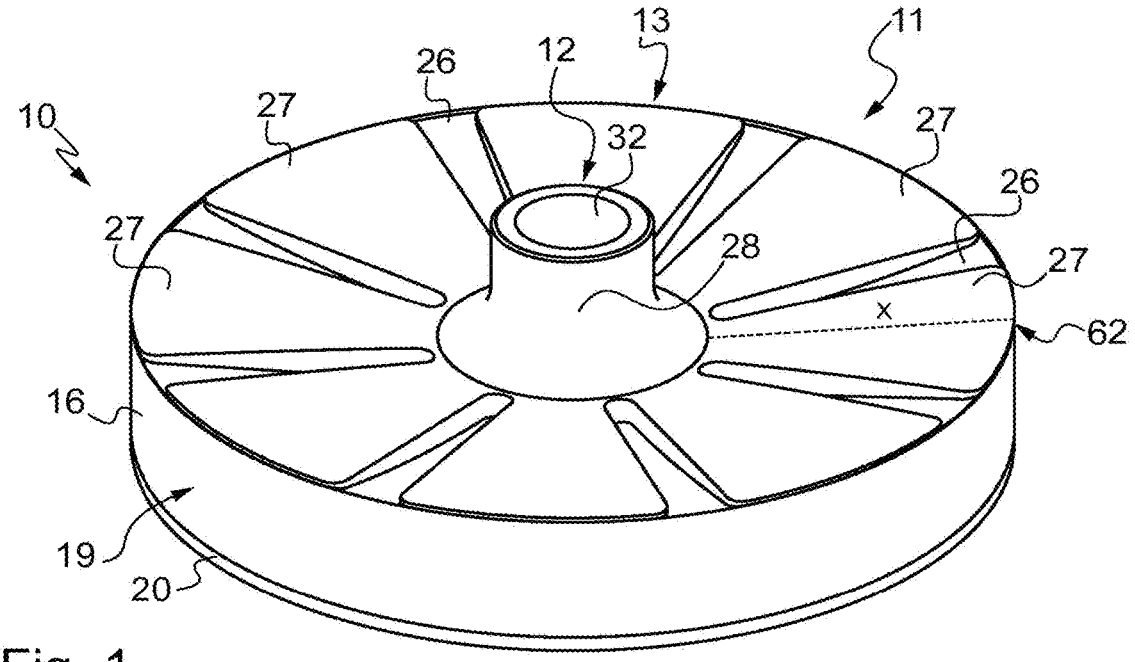
FIGS. 1 and 2 are respectively a perspective and cross-sectional view of a first embodiment of a surfacing tool according to the invention, in rest position.
Figure 2:
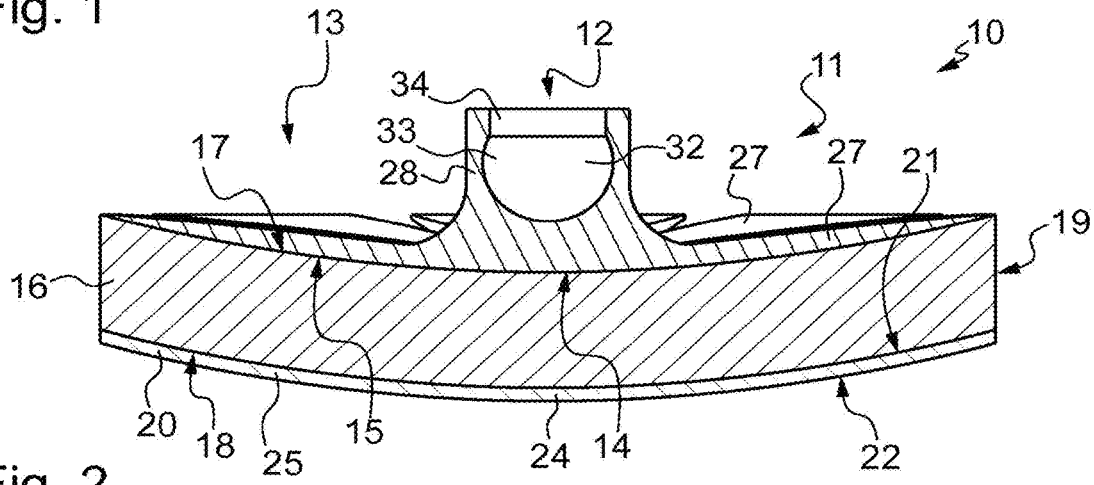

The tool 10 illustrated in FIGS. 1 and 2 comprises:

a base 11 comprising a rigid holder 12 and a flexible collar 13 encircling the rigid holder 12, which rigid holder 12 has a transverse end surface 14, and which collar 13 has a transverse end surface 15 that is located on the same side as the transverse end surface 14 of the rigid holder 12;

an elastically compressible interface 16 comprising a first transverse end surface 17, a second transverse end surface 18 and a lateral surface 19 extending from the periphery of the first transverse end surface 17 to the periphery of the second transverse end surface 18, the first transverse end surface 17 of the elastically compressible interface 16 being attached to the transverse end surface 14 of the rigid holder 12 and to the transverse end surface 15 of the collar 13; and a flexible buffer 20 having a first transverse end surface 21 that is attached to the second transverse end surface 18 of the elastically compressible interface 16 and a second transverse end surface 22 that is configured to be applied against a surface 23 to be worked (FIG. 3), which buffer 20 comprises a central portion 24 that is located plumb with the transverse end surface 14 of the rigid holder 12 and a peripheral portion 25 that is located transversely beyond this transverse end surface 14.

In the base 11, the flexible collar 13 is transversely beyond the rigid holder 12, which is placed centrally.

The flexible collar 13 has an outside diameter (large diameter) similar to the outside diameter of the interface 16 and of the buffer 20.

The inside diameter (small diameter) of the flexible collar 13 corresponds to the outside diameter of the holder 12, the collar 13 taking root laterally to the holder 12.

The rigid holder 12 and the flexible peripheral collar 13 are made of plastic molded into a single part, the holder 12 being bulky at least in the vicinity of the surface 14 in order to have the required rigidity whereas the collar 13 has a small wall thickness in order to be flexible.

The collar 13 has eight slits 26 that are radially oriented and equi-angularly distributed, so that the collar 13 is subdivided into eight petals 27 each having the overall shape of a truncated angular sector.

The subdivision of the collar 13 into petals contributes to allowing this collar to be flexible in order to conform to various curvatures of surfaces to be polished.

The surface 14 of the holder 12 is flush with the surface 15 of the collar 13 located on the same side.

On the other side, the holder 12 has a protruding lug 28 that serves to join the tool 10 to the spindle of a surfacing machine 29 shown in a simplified way in FIG. 3 by the arrows 30 and 31 which symbolize the driving forces applied to the tool 10 by the machine 29, which will be described below.

The lug 28 has a cavity 32 for accommodating the spindle head. The cavity 32 has a spherical segment 33 that has the overall shape of three-quarters of a sphere and an annular rib 34.

The spindle head provided to be accommodated in the cavity 32 comprises a sphere-segment end shaped like the segment 33 and a cylindrical segment of smaller diameter than the rib 34.

The lug 28 and the spindle of the machine are assembled by simple snap-fastening, the wall thickness of the lug 28 being sufficiently small to be able to deform to house the spherical portion of the spindle head in the segment 33.

When the spindle head is engaged in the cavity 32, the tool 10 interacts via a link of the ball-and-socket type with respect to the spindle.

As indicated above, the diameter of the interface 16 and of the buffer 20 corresponds to the outside diameter of the collar 13.

The interface 16 and the base 11 are attached by adhesive bonding of the surface 17 of the interface 16 and of the surfaces 14 and 15 of the base 11.

In the illustrated example, the elastically compressible interface 16 is a foam having a thickness of about 9 mm and the flexible buffer 20 has a thickness of about 1 mm.

The diameter of the interface 16 and of the buffer 20 is about 55 mm.

When the base 11 is at rest, i.e. in the absence of external stresses, the surface 15 of the collar 13, which as indicated above is flush with the surface 14, lies in the extension of the surface 14. Here, the shape of the surfaces 14 and 15 is that of one and the same partial sphere.

Figure 3:
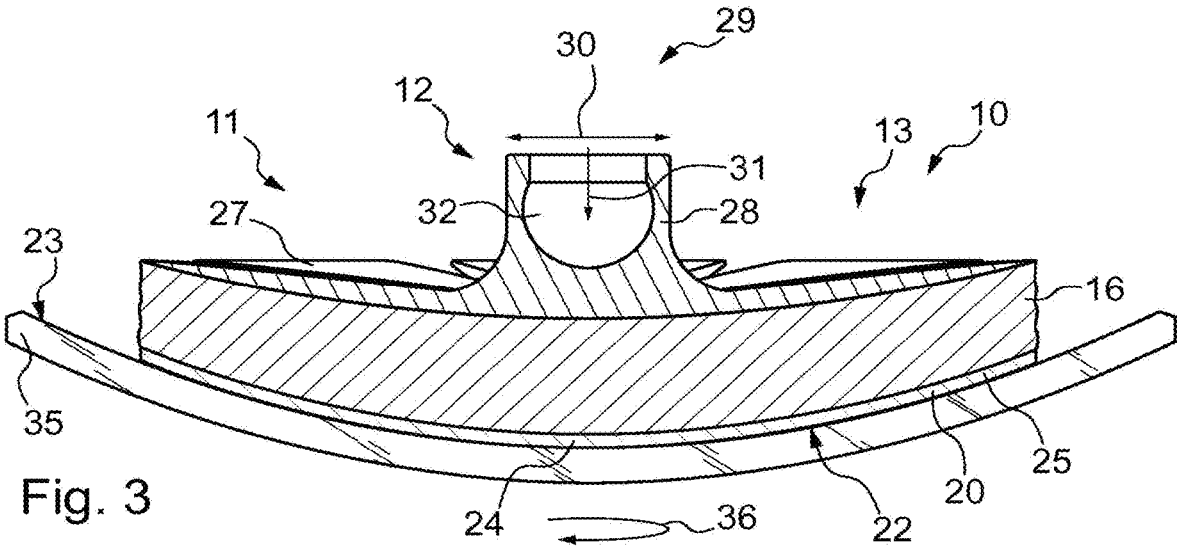
FIG. 3 is a view similar to FIG. 2, but showing this tool during surfacing of a surface of an ophthalmic lens.

In the example illustrated in FIGS. 1 to 3, when the tool 10 is in rest position, the end surface 14 of the holder 12 and the end surface 15 of the collar 13 have the shape of a partial sphere having a radius of curvature of about 110 mm.

By virtue of the collar 13, the area of contact between the interface 16 and the base 11 is particularly large since this area of contact corresponds to the areas of the surface 14 and surface 15.

FIG. 3 shows an ophthalmic lens 35 the optical surface 23 of which is in the process of surfacing with the tool 10, in order to decrease the roughness thereof.

The machine 29 places the tool 10 in contact with the surface 23 via the surface 22 of the buffer 20. By exerting, with the tool 10, the force 31, the machine 29 maintains a sufficient pressure on the surface 23 to force, by deformation of the interface 16, the buffer 20 to match the shape of the optical surface 23.

While the optical surface 23 is sprayed by means of a fluid, the lens 35 is driven to rotate, as shown by the arrow 36, the friction against the tool 10 being sufficient to drive the tool 10 to rotate.

A variable off-centeredness during the operation, by virtue of the reciprocal driving force 30, ensures the relative movement and the scan.

The surfacing operation requires an abrasive that may be contained in the buffer 20 or in the fluid.

During surfacing, the elastically compressible interface 16 allows the difference in curvature between the end surface 14 of the holder 12 of the tool and the optical surface 23 to be compensated for.

The peripheral portion 25 of the buffer 20 is joined to the holder 12 exclusively by the interface 16 and by the collar 13.

Contrary for example to the surfacing tool known in particular from French patent application 2 900 356 to which US patent application 2008/0171502 corresponds, there are no elastic return means such as a star-shaped part connecting the peripheral portion of the buffer to the holder.

Specifically, the collar 13 is configured to be sufficiently elastically deformable that there is no need for such elastic return means.

The base 11, which must not only be rigid in the vicinity of the end surface 14, but also flexible level with the lug 28, in order to allow the spindle of the machine to be snap-fastened, and elastic level with the collar 13, is advantageously made of PA11, of POM, of PA66, of PUR or of ELASTOLLAN®.

For example, there is a form of PA11 that has an elastic modulus E (Young's modulus) of 1320 N/mm$^2$ and a tensile elastic limit $\sigma_{MAX}$ of 35 N/mm$^2$; and ELASTOLLAN® 1164D has an elastic modulus EY of 300 N/mm$^2$ and a tensile elastic limit $\sigma_{MAX}$ of 40 N/mm$^2$.

It will be noted that these materials have a relatively high $\sigma_{MAX}$/E ratio, which makes them particularly suitable for use in the collar 13, as explained below.

Another advantageous material is for example PA66, one form of which has an elastic modulus of 2500 N/mm$^2$.

The collar 13 is configured so that the tool 10 is elastically deformable between the rest position that it takes in the absence of stress (FIGS. 1 and 2) and one or more reference positions in which the surface 22 is entirely pressed against a concave reference surface or various concave reference surfaces, just like in FIG. 3 in which the entire surface 22 of the tool 10 is pressed against the surface 23.

The tool 10 is here capable of deforming elastically in a particularly extensive range of curvatures, since it is configured to deform elastically from the rest position not only:

- to a first concave reference position in which the second transverse end surface 22 of the flexible buffer 20 is entirely pressed against a first concave reference surface 37 (FIG. 6) that is spherical, concave and of radius of 1500 mm;
- but also to a second concave reference position in which the second transverse end surface 22 of the flexible buffer 20 is entirely pressed against a second concave reference surface 40 (FIG. 5) that is spherical, concave and of radius of 40 mm.

The first concave reference surface 37 forms part of a trialing holder 38. The second reference surface 40 forms part of a trialing holder 41.

The elastic character of the deformation of the tool between the rest position and each of the first and second reference positions means that the tool is not permanently deformed, i.e. when the action of pressing the tool against the reference surface 37 or 40 ceases the tool returns to the rest position, possibly after a delay of a few seconds.

This elastic character of the tool 10 is furnished by the interface 16 and by the collar 13, here by virtue of its subdivision into petals and the geometry of the petals, which has been designed accordingly, as explained below.

By virtue of the capacity of the tool 10 to deform elastically in a range of curvatures of such extent, the assembly formed by the machine 29 and by the tool 10 may surface most common ophthalmic lenses.

It will be noted in this respect that, with already known tools, three different models of tools having different curvatures in the rest position are generally required to be able to surface the same range of curvatures.

Figure 4:
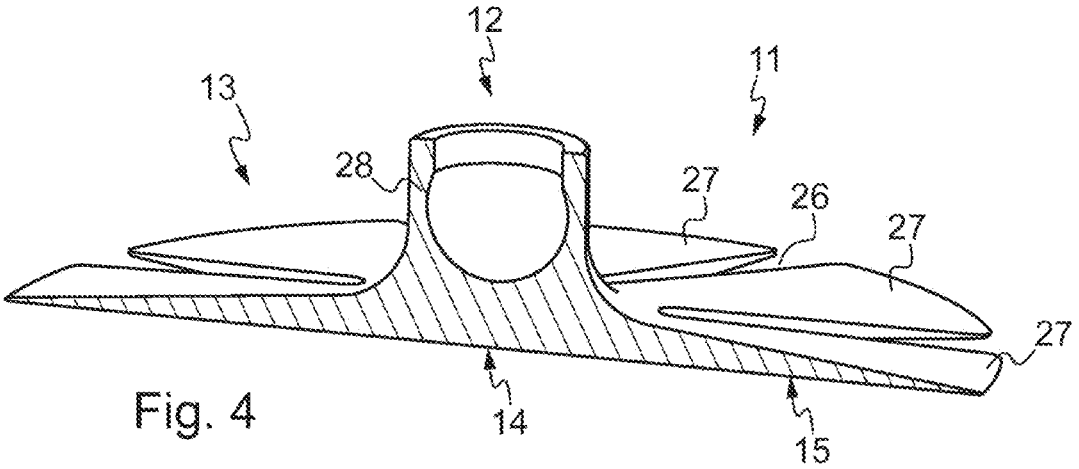
FIG. 4 is a perspective section view of the base of a second embodiment of the tool, the transverse end surface of the rigid holder and of the collar being planar (and not convex) in rest position.
Figure 5:
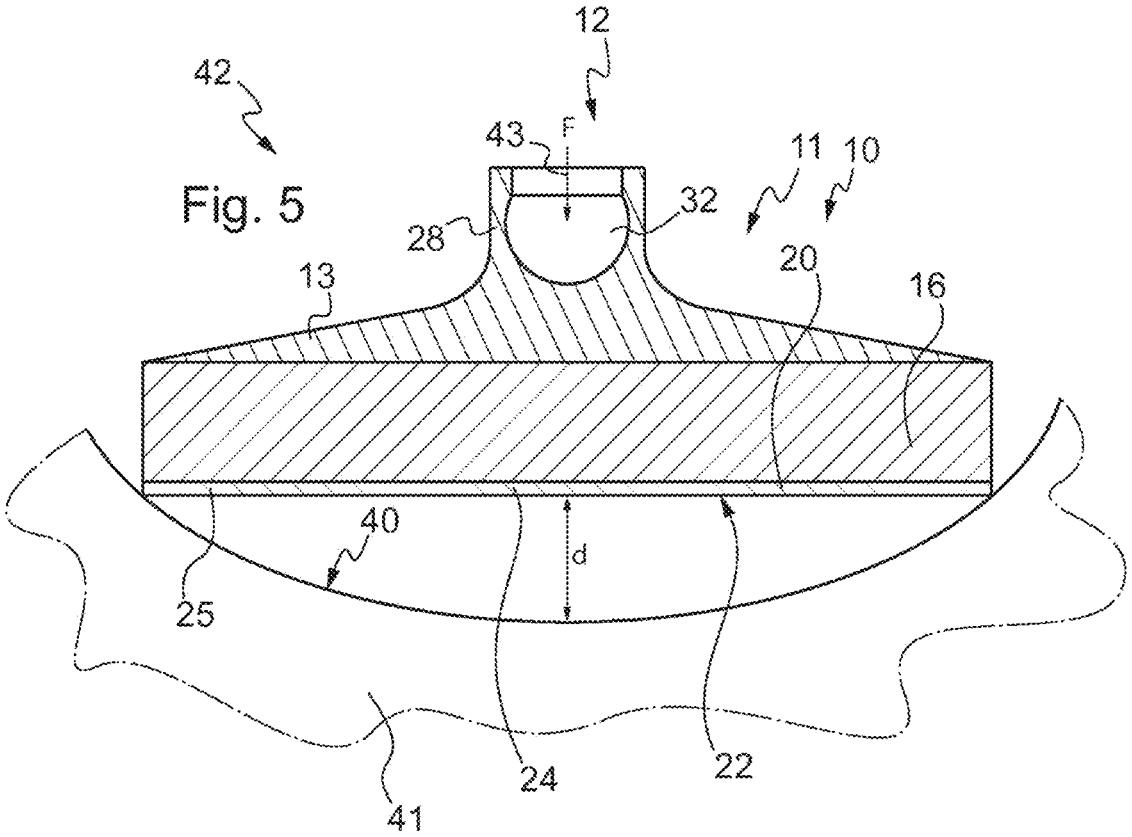
FIG. 5 is a schematic cross-sectional view illustrating this embodiment of the surfacing tool in rest position on a concave reference surface.
Figure 6:
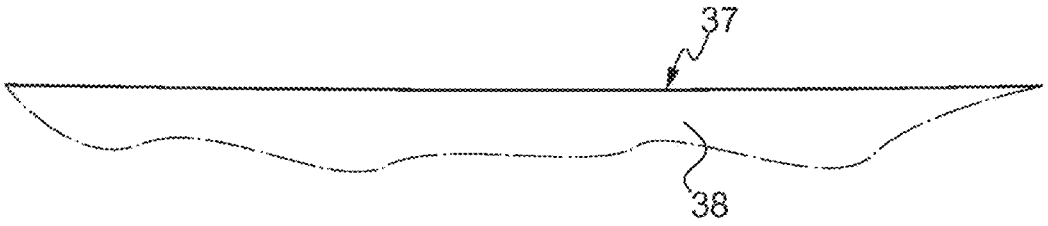
FIG. 6 is a schematic cross-sectional view illustrating another concave reference surface.

The embodiment of the tool 10 illustrated in FIGS. 4 and 5 is identical to the embodiment illustrated in FIGS. 1 to 3 except that in the rest position the transverse end surface 14 of the holder 12 and the transverse end surface 15 of the collar 13 are planar.

FIG. 5 shows this tool 10 in rest position on the second concave reference surface 40.

As indicated above, the concave reference surface 40 has a radius of 40 mm.

The holder 41 to which the reference surface 40 belongs forms part of a trialing device 42 that is used during development of the surfacing tool 10 to select the best candidates among samples (prototype tools) produced with various dimensions and various materials.

The trialing device 42 comprises a dynamic member for applying a linear force symbolized by the arrow 43. This member comprises at its far end a head similar to the head of a spindle of a surfacing machine, which is engaged in the cavity 32 of the lug 28.

The head of the member 43 is moved at a preset controlled speed, for example 25 mm/s, coaxially to the tool 10 when the tool 10 is coaxial with the surface 40. Thus, a force of magnitude F is applied to the holder 12 coaxially to the tool 10 when the tool 10 is coaxial to the surface 40.

The magnitude of the force F is measured and recorded during the movement of the member 43. The member 43 ceases to be driven when a preset threshold is reached, 160 N for example.

Figure 7:
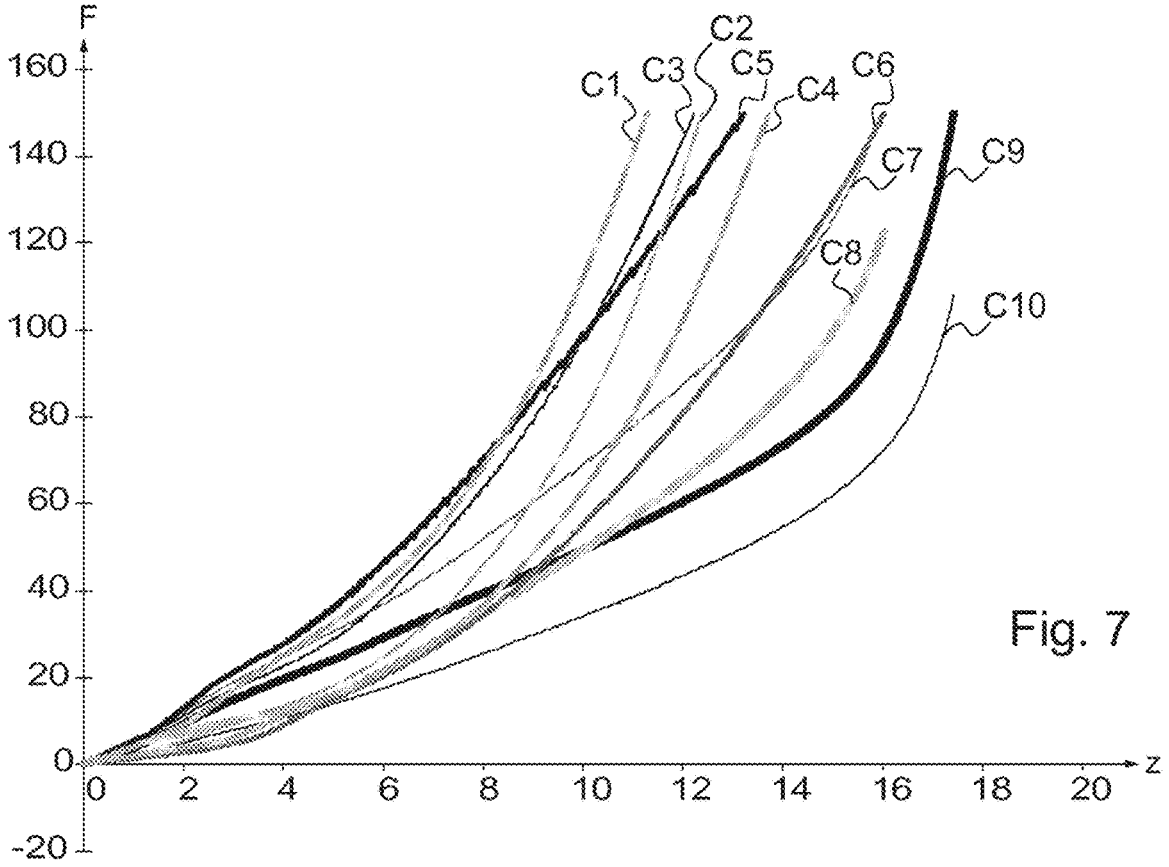
FIG. 7 is a graph illustrating, for this embodiment of the tool, the relationship between the applied force F, shown on the y-axis, and the corresponding movement z, shown on the x-axis, the various curves corresponding to various samples of this embodiment of the tool.

FIG. 7 is a graph showing the result of such trials, carried out at a speed of 25 mm/s until a force value of 160 N was reached.

The movement z of the member 43 is shown on the x-axis and the force F on the y-axis.

The curves C1 to C10 each correspond to a different sample.

Curves of uneven suffix, for example C1 and C3, relate to samples having the same interface 16 of a first nature. Curves of even suffix, for example C2 and C4, relate to samples having the same interface 16 of a second nature, more flexible than the interface 16 of first nature.

Curves having two successive suffixes the first of which is uneven and the second of which is even, for example C1 and C2, relate to samples having the same base 11, for example curves C1 and C2 relate to samples having a base 11 of a first nature and curves C3 and C4 to samples having the same base 11 of a second nature. The bases 11 of the various natures differ from one another only in the average thickness of the petals 27, which decreases with the suffixes of the curves (curves C1 and C2 relate to the samples having the petals 27 of largest average thickness whereas curves C9 and 010 relate to the samples having the petals 27 of smallest average thickness).

All the samples have the same flexible buffer 20.

Provided that the distance d (FIG. 5) between the center of the surface 22 of the buffer 20 and the surface 40 is non-zero, i.e. provided that the surface 22 is not entirely pressed against the surface 40, the distance d varies with the movement z. Subsequently, the movement z corresponds to the compression of the interface 16.

It may be seen that, for the most flexible tools, the curves (for example C9 and C10) exhibit a quite clear change in slope starting with the force for which the surface 22 is entirely pressed against the surface 40.

Figure 8:
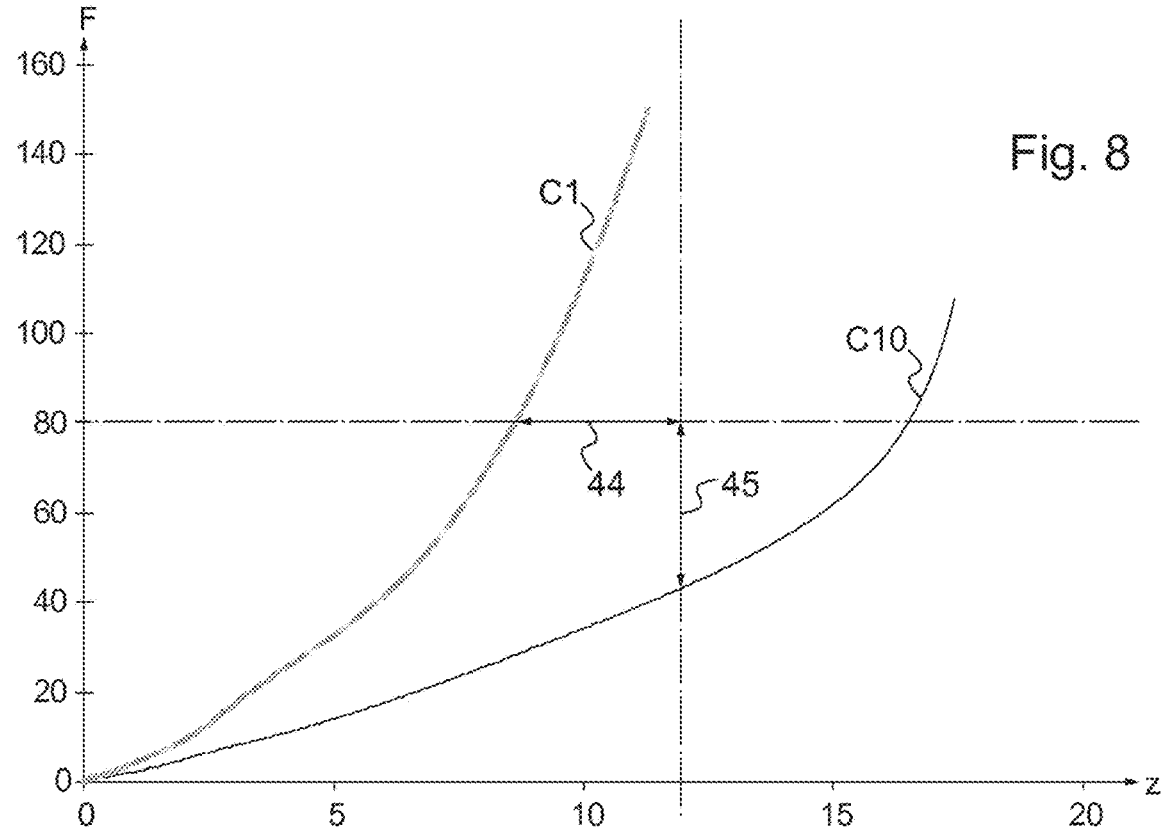
FIG. 8 is a graph similar to FIG. 7, but only showing two curves and two lines corresponding to a certain force and to a certain distance, in order to explain the behavior of the corresponding samples of the tool.

FIG. 8 is a graph similar to FIG. 7, but showing only curves C1 and C10 and a horizontal line corresponding to the fixed preset magnitude of the force 31 exerted by the machine 29 on the tool 10 (magnitude of about 80 N) and a vertical line corresponding to the distanced when the tool 10 is in rest position (distance of about 12 mm).

As the double arrow 44 shows, the tool to which the curve C1 relates does not bow sufficiently under the force 31 to be entirely pressed against the surface 40: for this magnitude of the force 31 the movement z is very much smaller than the distance d in the rest position of the tool.

As a result, with the force 31, the tool to which curve C1 relates exerts, on the surface 40, a contact pressure that is too localized to the edge.

As the double arrow 45 shows, the tool to which curve C10 relates is pressed against the surface 40 with a force of magnitude far below the magnitude of the force 31.

As a result, with the force 31, the tool to which curve C10 relates exerts, on the surface 40, a pressure that is too localized to the center.

It will be understood that a tool the curve of which passes through the point of intersection between the two lines of FIG. 8 exerts a relatively uniform pressure on the surface 40.

This is the case for the tool to which curve C6 relates.

It will be noted that a tool capable of exerting a uniform pressure on the surface to be worked will have an excellent surfacing behavior, which will ensure an excellent performance is achieved thereby in terms of the obtained quality of appearance of the worked surface and also in terms of rapidity of execution, the uniformity of the pressure favoring the rapidity of the achievement of a sufficient removal of material from all of the worked surface.

Generally, it is in practice advantageous to configure a tool 10 provided to work a concave surface so that the value of the force applied to the holder 12 coaxially to the tool 10 when the tool 10 is coaxial with a concave reference surface similar to the surface 40 (radius of 40 mm) is comprised between 30 N and 180 N.

In an assembly such as illustrated in FIG. 3 in which the machine 29 is configured to apply, to the holder 12 of the tool 10, a preset machine force 31 of constant value, it is advantageous for the tool 10 to be configured so that the value of the force applied to the holder 12 coaxially to the tool 10 while the tool 10 is coaxial with a reference surface such as the surface 40 in order to make the tool pass from the rest position to a position in which the tool is pressed against this surface, is comprised between 85% and 100% of this constant value of the machine force.

It is clear from the graph of FIG. 7 that it is advantageous for the collar 13 to be configured so that the force-to-movement ratio between, on the one hand, the value of the force F applied to the holder 12 coaxially to the tool 10 for making the tool pass from the rest position to the position in which the surface 22 is pressed against the surface 40 while the tool 10 is coaxial with the surface 40, and, on the other hand, the value of the distance z traveled by the holder between the rest position and the position in which the surface 22 is pressed against the surface 40, is between 3 N/mm and 15 N/mm with a set movement speed of 25 mm/s.

It is also clear from the graph of FIG. 7 that particularly advantageous values of this ratio are comprised between 5 N/mm and 8 N/mm with a set movement speed of 25 mm/s.

Of course, the trials described above with reference to FIGS. 5, 7 and 8 were carried out at room temperature.

How the petals 27 are arranged to procure the tool 10 the elastic deformation capacity described above will now be described.

Each petal 27 has a thickness that varies as a function of the distance x to its far end 62, the thickness being constant at each distance x.

In practice, the thickness of each petal increases between its far end 62 and its root, via which it is laterally joined to the rigid holder 12.

An example of determination of the geometry of the petals 27 will now be described.

Figure 9:
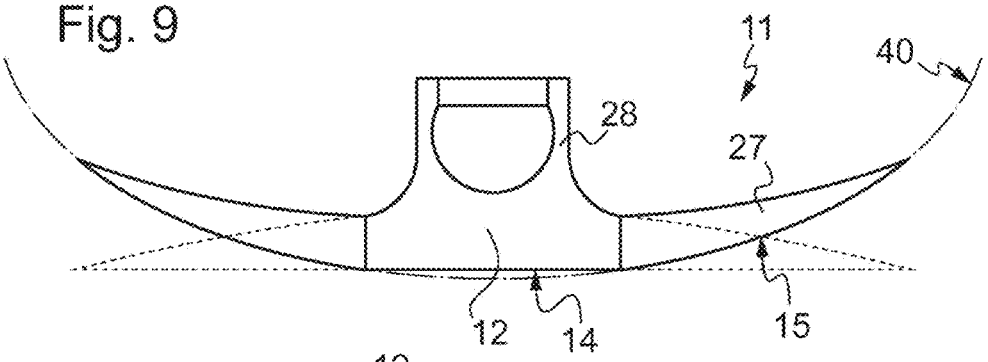
FIG. 9 is a schematic cross-sectional view of the base of this embodiment of the tool applied to the concave reference surface of FIG. 5, shown by the dot-dashed line, the rest position of the base being shown by the dashed line.

It is assumed, as shown in FIG. 9, that the base 11 illustrated in FIG. 4 is applied to the surface 40, which is represented by the dot-dashed line (the position of the base 11 when the tool 10 is at rest is shown by the dashed line).

The end surface 14 of the rigid holder 12 is not deformable and therefore does not conform to the surface 40.

It is assumed that the flexibility of the collar 13 is such that the surface 15 of the collar 13 conforms to the surface 40, i.e. that the surface 15 is entirely pressed against the surface 40.

Thus, for each petal 27 the surface 15 takes the same curvature as the surface 40, i.e. for each petal 27 the surface 15 adopts a radius of 40 mm.

Under these conditions it is sought how to make the thickness of the petals 27 vary as a function of the distance x to their far end 62 so that the pressure exerted by each petal 27 on the surface 40 is uniform.

It may be demonstrated that this is achieved when, at each distance x, the thickness h(x) of the petal is given by the formula:

$$h(x)^3 = \frac{K}{b(x)} \int_0^x \left( \int_0^x b(x)dx \right) dx$$

with b(x) the width of the petal at the distance x and K a constant.

It may be demonstrated that the constant K is equal to $$\frac{12RQ_{sp}}{E}$$

where R is the radius of the surface 40 (here 40 mm); $Q_{sp}$ is the load per unit area of the petals 27, which is assumed to be constant; and E is the elastic modulus (Young's modulus) of the material of the petals 27.

Here where the surface 14 is considered as being away from the surface 40 (the surface 14 is not deformed and therefore remains planar), the load per unit area $Q_{sp}$ of the petals 27 is the ratio between the force provided to be applied to the holder 12 (for example the magnitude of force 31, about 80 N) and the area of the surface 15.

If the width of a petal 27 as a function of the distance x to the far end 62 of the petal is expressible in the form of a polynomial:

$$b(x) = \sum_{i=0}^{n} a_n x^n = a_0 + a_1 x + a_2 x^2 + \cdots + a_n x^n$$

Then at each distance x the thickness of a petal is given by the formula:

$$h(x)^3 = \frac{K}{b(x)}\left(\frac{a_0 x^2}{2} + \frac{a_1 x^3}{6} + \ldots + \frac{a_n x^{n+2}}{(n+1)(n+2)}\right)$$

Here the petals have the shape of a truncated angular sector. By making the (quite precise) approximation that each petal is of trapezium shape, the width of the petal as a function of the distance x to the far end 62 of the petal is expressible in the form of the polynomial:

$$b(x)=a_0+a_1 x$$

Thus, at each distance x the thickness of the petal is given by the formula:

$$h(x)^3 = \frac{K}{b(x)}\left(\frac{a_0 x^2}{2} + \frac{a_1 x^3}{6}\right)$$

As regards the values of $a_0$ and $a_1$, for each petal the chord of the arc that the shape of the far end 62 describes is here 18 mm, the cord of the arc that the shape of the near end describes is here 5.4 mm, and the distance between these two arcs is here 19 mm. As a result, $a_0$ is equal to 18 mm (at the far end 62, x is equal to 0) and $a_1$ is equal to −0.663 (at the far end 62, x is equal to 19 and b is equal to 5.4).

As regards the constant K, it is chosen here, to achieve a margin of safety, to set severer conditions than those mentioned above.

It will be recalled (see above) that K is equal to $$\frac{12RQ_{sp}}{E}$$

where R is the radius of the surface 40; $Q_{sp}$ is the load per unit area of the petals 27, which is here considered to be constant and equal to the ratio between the force provided to be applied to the holder 12 and the area of the surface 15; and E is the elastic modulus of the material of the petals.

For safety's sake, R is set to 35 mm (instead of 40 mm) and the force provided to be applied to the holder 12 is set to 100 N (instead of 80 N). The area of the surface 15 is 1780 $mm^2$ in total for the eight petals 27. The elastic modulus of the material of the petals is 2500 $N/mm^2$. The constant K is then equal to 0.0094.

Thus, the following formula is obtained:

$$h(x)^3 = \frac{0.0094}{18 - 0.663x}(9x^2 - 0.1105x^3)$$

The following table gives the value of h (in mm) as a function of x (in mm):

| x | h |
|---|---|
| 0 | 0 |
| 1 | 0.17 |
| 2 | 0.27 |
| 3 | 0.36 |
| 4 | 0.44 |
| 5 | 0.51 |
| 6 | 0.59 |
| 7 | 0.66 |
| 8 | 0.73 |
| 9 | 0.80 |
| 10 | 0.87 |
| 11 | 0.94 |
| 12 | 1.01 |
| 13 | 1.09 |
| 14 | 1.16 |
| 15 | 1.24 |
| 16 | 1.33 |
| 17 | 1.42 |
| 18 | 1.52 |
| 19 | 1.63 |

With such a geometry of the petals 27 (law of variation in thickness related to the outline of the petals), when the petals 27 are forced to deform according to the calculational assumptions, then the petals 27 will exert on the surface against which they are pressed a uniform pressure (of constant value). It will be recalled in this respect that one of the calculational assumptions is that the load per unit area $Q_{sp}$ is constant.

If the spherical surface against which the petals 27 are pressed has a radius R different from that used in the calculation (for example 40 mm instead of 35 mm), the pressure exerted on this surface by the petals 27 remains uniform, but is obviously of different magnitude (the smaller the radius R the higher the pressure).

Likewise, if the magnitude of the force applied to the holder 12 is different (for example 80 N instead of 100 N), the pressure exerted by the petals 27 remains uniform but is of different magnitude.

In practice, in the tool 10, the flexible buffer 20 and the elastically compressible interface 16 are located between the surface to be worked and the surface 15 of the collar 13.

It will be understood that if the surface 22 of the buffer 20 is entirely pressed against a spherical surface by a force exerted on the holder 12 coaxially to the tool while the tool is coaxial with the surface to be worked, then the surface 15 of the collar 13 will adopt a spherical or approximately spherical configuration, and therefore the pressure exerted by the petals 27 on the elastically compressible interface will be uniform or approximately uniform. Therefore, plumb with the collar 13, the pressure exerted by the tool 10 on the surface to be worked (via the surface 22 of the buffer 20) will be uniform or approximately uniform.

In practice, the base 11 also exerts a pressure on the elastically compressible interface 16 via the transverse end surface 14 of the holder 12. Therefore, the tool 10 also exerts (via the surface 22 of the buffer 20) on the surface to be worked a pressure plumb with the holder 12.

As the holder 12 does not exert on the interface 16 any force due to its deformation (it is configured to not deform), the pressure exerted by the holder 12 on the interface 16 (which transmits it to the surface to be worked via the buffer 20) is in principle equal to the ratio between the magnitude of the force applied to the holder 12 and the area of the surface 14.

In order to take into account the pressure exerted by the holder 12 on the interface 16, it is possible to configure the geometry of the petals 27 by assuming that, for a surface to be worked having a preset radius of curvature, for example 35 mm as above, the load per unit area exerted by the surfaces 14 and 15 is uniform, i.e. the load per unit area $Q_{sp}$ of the surface 15 of the petals 27 is equal to the load per unit area of the surface 14 of the holder 12.

For example, if as above the magnitude of the force exerted on the holder 12 is equal to 100 N and the total area of the surface 15 (for the eight petals 27) is equal to 1780 $mm^2$, and the area of the surface 14 is equal to 201 $mm^2$, then the load per unit area $Q_{sp}$ of the surface 15 will be set equal to 100/(1780+201)=0.050 $N/mm^2$.

For the radius R selected to configure the geometry of the petals 27 (for example 35 mm as above), the pressure exerted by the tool 10 on the surface to be worked (via the surface 22 of the buffer 20) will be the same plumb with the holder 21 and plumb with the collar 13.

It will be recalled (see above) that the uniform character of the pressure exerted by the tool on the surface to be worked allows the surface to be worked to be rapidly surfaced and a given quality of appearance to be rapidly obtained.

For radii different from the selected radius R, the pressure exerted by the tool 10 on the surface to be worked (via the surface 22 of the buffer 20) will be different plumb with the holder 21 and plumb with the collar 13. For example, for radii larger than the selected radius R, the pressure plumb with the collar 13 will be lower than the pressure plumb with the holder 12.

In practice, the tool is off-centered with respect to the surface to be worked and it is relatively common for the surface to be worked to not be spherical; however, the behavior of a tool the petals of which are configured as has just been explained remains excellent.

It will be noted in this respect that the surfaces that the tool 10 is able to surface are not limited to surfaces against which the surface 22 of the buffer 20 may be entirely pressed when the tool 10 and the surface to be worked are centered with respect to each other. On the contrary, the tool 10 is able to surface many surfaces against which the surface 22 can be mostly but not entirely pressed.

In addition to what was explained above, in order to allow the petals to bow without getting in the way of each other and to ensure a sufficient bonding area between the interface 16 and the base 11, the ratio between a combined total area of the surfaces 15 of the petals, and an annular area extending from a radius defined by an innermost extent of the cavities to a radius defined by the outermost extent of the petals, is between 30 and 80%.

In addition to what was explained above, it is also recommended for the deformation of the material of the petals 27 to remain in the elastic domain.

It may be demonstrated that this condition is met when, at each distance x from the far end 62 of the petal, the thickness of the petal is smaller than:

$$h_{MAX} = \frac{R\sigma_{MAX}}{2E}$$

where $\pi_{MAX}$ is the tensile elastic limit of the material of the petals, E is the elastic modulus (Young's modulus) of the material of the petals and R is the aforementioned radius.

If for example the material of the collar 13 (and therefore of the base 11) is ELASTOLLAN® 1164D which, as indicated above, has an elastic modulus E of 300 $N/mm^2$ and a tensile elastic limit $\sigma_{MAX}$ of 40 $N/mm^2$, for a radius of curvature R of 35 mm, the maximum thickness $h_{MAX}$ is 2.33 mm.

It may be seen that the higher the ratio $\sigma_{MAX}/E$, the higher the maximum possible thickness of the petal, this being important if the sought-after tool behavior is to be obtained, as explained above with reference to FIGS. 7 and 8.

In the above examples, the radius R selected represented the severest conditions of use of the tool, here the smallest radius of a concave surface.

The tool will then also be capable of working under less severe conditions.

It may for example be seen that if the radius R is larger, the maximum thickness $h_{MAX}$ of the petals is larger, and hence petals configured for the smallest radius will be suitable for other radii.

It will be noted that the formulae given above also apply when at rest the surface 15 of the petals is curved, provided that R is then the inverse of the curvature difference between the surface 15 in the rest position and the curved position to be achieved.

For example, if the transverse end surface 15 of the collar 13 has a radius of 400 mm at rest and the curved position to be achieved has a radius of 40 mm, then R=1/(1/40−1/400)=1/(9/400)=400/9=44.44 mm.

Figure 10:
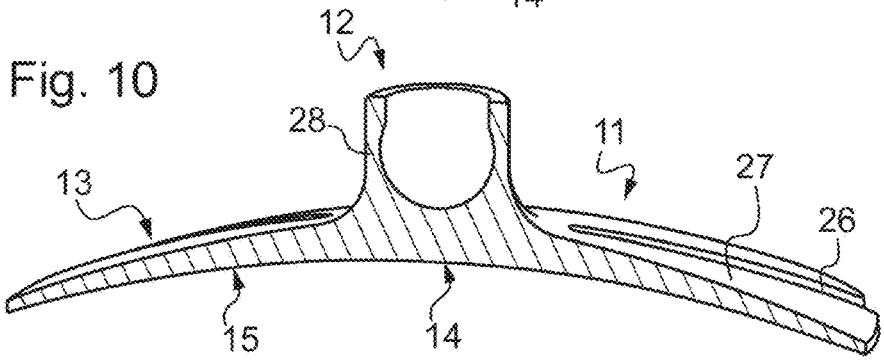
FIGS. 10 and 11 are views similar to FIGS. 4 and 5 for a third embodiment of the tool, the transverse end surface of the rigid holder and of the collar being concave in rest position.
Figure 11:
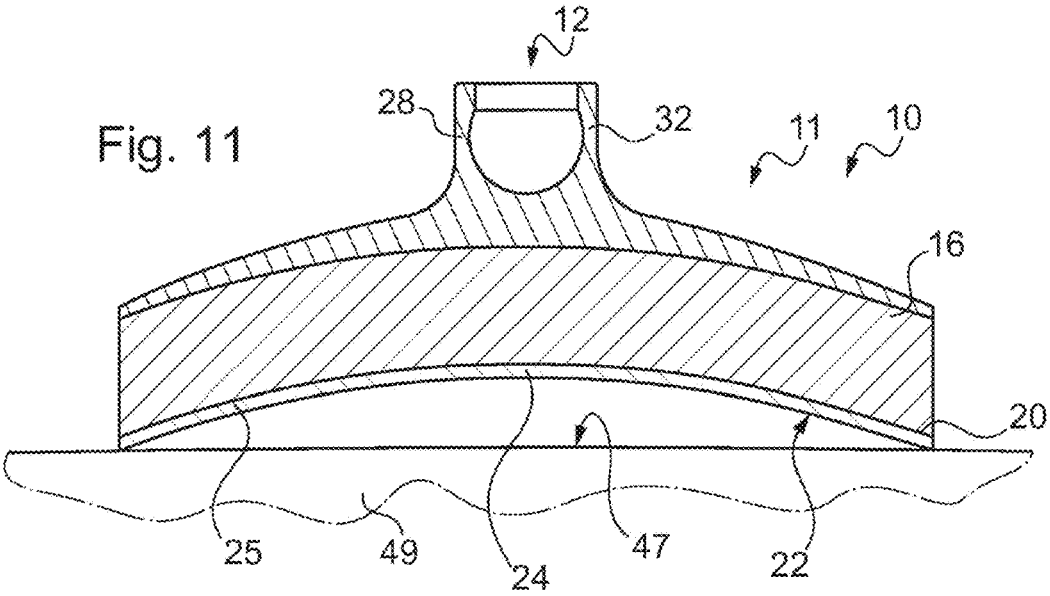

The embodiment of the tool 10 illustrated in FIGS. 10 and 11 is similar to the embodiments illustrated in FIGS. 1 to 3 and in FIGS. 4 and 5, except that in the rest position the transverse end surface 14 of the holder 12 and the end surface 15 of the collar 13 are concave (and not convex as in FIGS. 1 to 3 or planar as in FIGS. 4 and 5).

Here, the surface 14 and the surface 15 have the shape of a partial sphere having a radius of curvature of about 110 mm.

Whereas the embodiment of the tool 10 illustrated in FIGS. 1 to 3 and the embodiment illustrated in FIGS. 4 and 5 are intended for concave surfaces to be worked, the embodiment illustrated in FIGS. 10 and 11 is intended for convex surfaces to be worked.

Here, the collar 13 is configured so that the tool 10 is elastically deformable between the rest position that it takes in the absence of stress (FIGS. 10 and 11) and one or more reference positions in which the surface 22 is entirely pressed against a convex reference surface or various convex reference surfaces.

Figure 12:
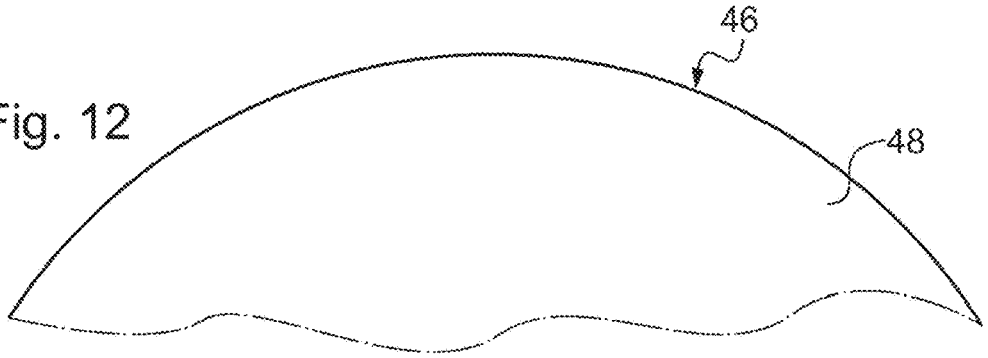
FIG. 12 is a schematic cross-sectional view illustrating a convex reference surface different from that illustrated in FIG. 11.

Here, the tool 10 illustrated in FIGS. 10 and 11 is capable of deforming elastically in a particularly extensive range of curvatures, since it is configured to deform elastically from the rest position not only:

- to a first convex reference position in which the second transverse end surface 22 of the flexible buffer 20 is entirely pressed against a first convex reference surface 46 (FIG. 12) that is spherical, convex and of radius of 40 mm;
- but also to a second convex reference position in which the second transverse end surface 22 of the flexible buffer 20 is entirely pressed against a second convex reference surface 47 (FIG. 11) that is spherical, convex and of radius of 1500 mm.

The first convex reference surface 46 forms part of a trialing holder 48. The second convex reference surface 47 forms part of a trialing holder 49.

Generally, the description given above for the embodiment of the tool 10 illustrated in FIGS. 1 to 3 and for the embodiment illustrated in FIGS. 4 and 5 applies to the embodiment of the tool 10 illustrated in FIGS. 10 and 11, provided that the curvature inversion is taken into account.

In these various embodiments of the tool 10 or in other embodiments arranged similarly, it is advantageous to employ a collar 13 (or more generally a base 11) having the following features:

elastic modulus E of the material of the collar 13 (and therefore of the base 11) comprised between 200 $N/mm^2$ and 5000 $N/mm^2$;

outside diameter of the collar 13 (and therefore of the base 11) comprised between 20 and 90 mm;

radius of curvature of the transverse end surface 15 in the rest position comprised between 30 and 500 mm;

number of petals comprised between 6 and 16;

length of each petal comprised between 10 and 30 mm; and/or thickness of each petal comprised between 0.5 and 5 mm.

In similar embodiments the constant K of the above formulae is selected at least partially experimentally, for example as shown in FIGS. 7 and 8.

In variants of the tool 10, in the reference positions the surface 22 of the buffer 20 is not entirely pressed against a reference surface such as 37, 40, 46 or 47 but is only partially pressed thereagainst, the radius of the portion of the surface 22 pressed against the surface to be worked for example being equal to at least half the radius of the surface 22 (if the pressed-down portion comprises the center of the surface 20) or (if the pressed-down portion is annular) the difference between the inside radius and the outside radius for example being equal to at least half the radius of the surface 22. For example, if the surface 22 has a radius of 55 mm and the pressed-down portion comprises the center of the surface 20, the pressed-down portion has a radius of at least 27.5 mm; and if the pressed-down portion is annular, the difference between the outside radius and the inside radius of the pressed-down portion is a least 27.5 mm.

FIGS. 11 to 15 show various variants of the base 11 in which the petals are differently shaped.

Figure 13:
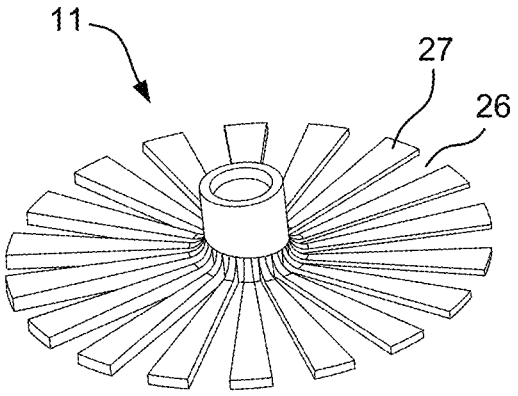
FIGS. 13 to 17 are perspective views of the base of other embodiments of the surfacing tool.

In the variant illustrated in FIG. 13, the slits 26 between the petals 27 have a larger angular amplitude and the number of petals is higher.

Figure 14:
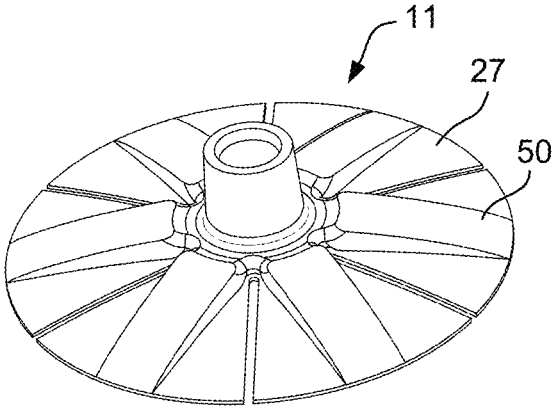

In the variant illustrated in FIG. 14, each petal 27 comprises on the side of the lug 28 (and therefore on the side opposite to the transverse end surface 15) a radially oriented protruding rib 50.

Figure 15:
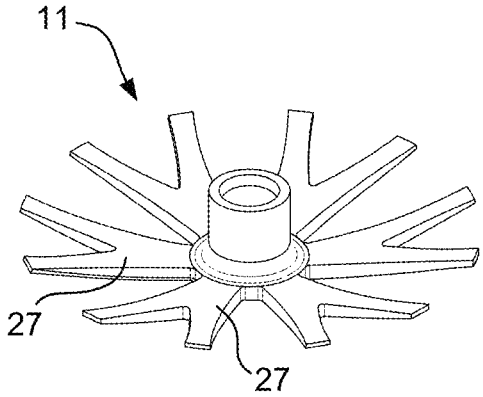

In the variant illustrated in FIG. 15, each petal 27 is Y-shaped and attached via its base to the rigid holder 12.

Figure 16:
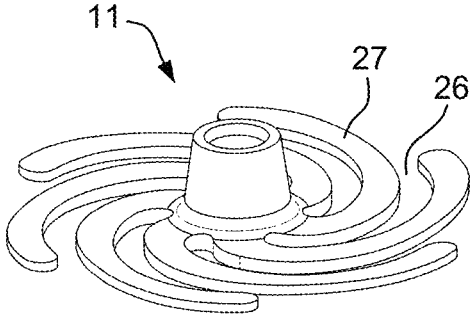

In the variant illustrated in FIG. 16, the petals 27 are subdivided by curved slits 26.

Figure 17:
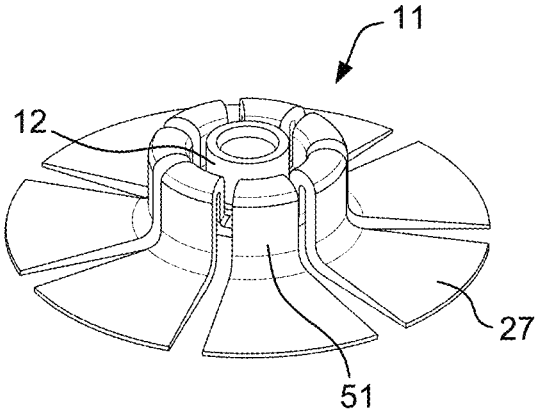

In the variant illustrated in FIG. 17, each petal 27 takes root on an end of an arm 51 of U-shaped cross section placed transversely to this petal, the other end of this arm taking root on the rigid holder 12.

As variants (not illustrated):

the slits 26 bounding the petals 27 have different shapes, for example with undulations; and/or in the base 11, the collar 13 is replaced by a collar that is elastic and flexible but not subdivided into petals.

Many other variants are possible depending on the circumstances and it will be recalled, in this respect, that the invention is not limited to the examples described and represented.

The invention claimed is:

1. An optical-grade surfacing tool (10), comprising:

a base (11) comprising a rigid holder (12) and a flexible collar (13) encircling said rigid holder (12), said rigid holder (12) having a transverse end surface (14), and said collar (13) having a transverse end surface (15) that is located on a same side as the transverse end surface (14) of the rigid holder (12);

an elastically compressible interface (16) comprising a first transverse end surface (17), a second transverse end surface (18), and a lateral surface (19) extending from a periphery of the first transverse end surface (17) to a periphery of the second transverse end surface (18), the first transverse end surface (17) of the elastically compressible interface (16) being attached to the transverse end surface (14) of the rigid holder (12) and to the transverse end surface (15) of the collar (13); and a flexible buffer (20) having a third transverse end surface (21) that is attached to the second transverse end surface (18) of the elastically compressible interface (16) and a fourth transverse end surface (22) that is configured to be applied against a surface (23) to be worked, said buffer (20) comprising a central portion (24) that is located plumb with the transverse end surface (14) of the rigid holder (12) and a peripheral portion (25) that is located transversely beyond the transverse end surface (14), said peripheral portion (25) being joined to the holder (12) exclusively by said interface (16) and by said collar (13), and said collar (13) being elastically deformable configured so that the tool (10) elastically deforms between a rest position in which the tool is free of any force applied for pressing the flexible buffer (22), and a reference position in which the second transverse end surface (22) of the flexible buffer (20) is pressed against a reference surface (37, 40, 46, 47) that is spherical with a radius ranging from 40 mm and 1500 mm, wherein the collar (13) is subdivided into petals, each of the petals (27) extending from the rigid holder to a far end, and wherein each of the petals (27) has an axial thickness that varies as a function of a distance x from the holder to the far end of the petal, and wherein the thickness for each said petal is the same at any given distance x.

2. The tool as claimed in claim 1, wherein:

for a surface to be worked that is concave, the tool is configured to assume a first concave reference position in which the second transverse end surface (22) of the flexible buffer is pressed against a first concave reference surface (37) that is spherical, concave and of radius of 1500 mm, and also a second concave reference position in which the second transverse end surface (22) of the flexible buffer is pressed against a second concave reference surface (40) that is spherical, concave and of radius of 40 mm; and for a surface to be worked that is convex, the tool is configured to assume a first convex reference position in which the second transverse end surface (22) of the flexible buffer is pressed against a first convex reference surface (46) that is spherical, convex and of radius of 40 mm, and also a second convex reference position in which the second transverse end surface (22) of the flexible buffer is pressed against a second convex reference surface (47) that is spherical, convex and of radius of 1500 mm.

3. The tool as claimed in claim 1, wherein the tool has an elastic stiffness, furnished by the interface (16) and the collar (13), such that the tool (10) transitions from the rest position to the reference position when a force comprised between 30 N and 180 N is applied to the holder (12) coaxially to the tool (10) while the tool (10) is coaxial with the reference surface (40, 47).

4. The tool as claimed in claim 1, wherein said collar (13) has an elastic stiffness such that the tool (10) transitions from the rest position to the reference position when a force is applied to the holder (12) coaxially to the tool while the tool (10) is coaxial with the reference surface (40, 47) causing the holder (12) to travel a distance from the rest position to the reference position, where the holder (12) travels the distance at a set movement speed of 25 mm/s, and a ratio of a value of the force and a value of the distance traveled by the holder (12) from the rest position to the reference position is between 3 N/mm and 15 N/mm.

5. The tool as claimed in claim 4, wherein said ratio is comprised between 5 N/mm and 8 N/mm.

6. The tool as claimed in claim 1, wherein the transverse end surface (15) of the collar (13) is flush with the transverse end surface (14) of the holder (12).

7. The tool as claimed in claim 1, wherein said petals (27) are subdivided by radially oriented slits (26).

8. The tool as claimed in claim 1, wherein a combined total surface area of the petals (27) is between 30 and 80% of an annular area extending from the rigid holder (12) with an inner radius defined by an innermost extent of the cavities to an outer radius defined by the outermost extent of the petals.

9. An assembly comprising a polishing machine (29) and a tool as claimed in claim 1, wherein said machine (29) is configured to apply, to the holder (12) of the tool (10), a preset machine force (31) of constant value, and wherein a stiffness of said tool (10) is configured so that the tool transitions from the rest position to the reference position when between 85% and 100% of said constant value of the machine force (31) is applied to the holder (12) coaxially to the tool (10) while the tool is coaxial with the reference surface (40).

10. The tool as claimed in claim 2, wherein the tool has an elastic stiffness, furnished by the interface (16) and the collar (13), such that the tool (10) transitions from the rest position to the reference position when a force comprised between 30 N and 180 N is applied to the holder (12) coaxially to the tool (10) while the tool (10) is coaxial with the reference surface (40, 47).

11. The tool as claimed in claim 2, wherein said collar (13) has an elastic stiffness such that the tool (10) transitions from the rest position to the reference position when a force is applied to the holder (12) coaxially to the tool while the tool (10) is coaxial with the reference surface (40, 47) causing the holder (12) to travel a distance from the rest position to the reference position, where the holder (12) travels the distance at a set movement speed of 25 mm/s, and a ratio of a value of the force and a value of the distance traveled by the holder (12) from the rest position to the reference position is between 3 N/mm and 15 N/mm.

12. The tool as claimed in claim 3, wherein said collar (13) has an elastic stiffness such that the tool (10) transitions from the rest position to the reference position when a force is applied to the holder (12) coaxially to the tool while the tool (10) is coaxial with the reference surface (40, 47) causing the holder (12) to travel a distance from the rest position to the reference position, where the holder (12) travels the distance at a set movement speed of 25 mm/s, and a ratio of a value of the force and a value of the distance traveled by the holder (12) from the rest position to the reference position is between 3 N/mm and 15 N/mm.

13. The tool as claimed in claim 2, wherein the transverse end surface (15) of the collar (13) is flush with the transverse end surface (14) of the holder (12).

14. An optical-grade surfacing tool (10), comprising:

a base (11) comprising a rigid holder (12) and a flexible collar (13) encircling said rigid holder (12), said rigid holder (12) having a transverse end surface (14), and said collar (13) having a transverse end surface (15) that is located on a same side as the transverse end surface (14) of the rigid holder (12);

an elastically compressible interface (16) comprising a first transverse end surface (17), a second transverse end surface (18), and a lateral surface (19) extending from a periphery of the first transverse end surface (17) to a periphery of the second transverse end surface (18), the first transverse end surface (17) of the elastically compressible interface (16) being attached to the transverse end surface (14) of the rigid holder (12) and to the transverse end surface (15) of the collar (13); and a flexible buffer (20) having a third transverse end surface (21) that is attached to the second transverse end surface (18) of the elastically compressible interface (16) and a fourth transverse end surface (22) that is configured to be applied against a surface (23) to be worked, said buffer (20) comprising a central portion (24) that is located plumb with the transverse end surface (14) of the rigid holder (12) and a peripheral portion (25) that is located transversely beyond the transverse end surface (14), said peripheral portion (25) being joined to the holder (12) exclusively by said interface (16) and by said collar (13), and said collar (13) being elastically deformable configured so that the tool (10) elastically deforms between a rest position in which the tool is free of any force applied for pressing the flexible buffer (22), and a reference position in which the second transverse end surface (22) of the flexible buffer (20) is pressed against a reference surface (37, 40, 46, 47) that is spherical with a radius ranging from 40 mm and 1500 mm, wherein the collar (13) is subdivided into petals (27), and wherein for each petal (27) of said petals, a thickness h(x) of the petal (27) is given by the formula:

$$h(x)^3 = \frac{K}{b(x)} \int_0^x \left( \int_0^x b(x)dx \right) dx$$

where x is a distance from a far end of the petal, b(x) is a width of the petal at the distance x, and K is a constant.

15. The tool as claimed in claim 14, wherein the width of the petal (27) as a function of the distance x from the far end of the petal is expressed as:

$$b(x) = \sum_{i=0}^{n} a_n x^n = a_0 + a_1 x + a_2 x^2 + \cdots + a_n x^n$$

so that at any distance x, the thickness of the petal is given by the formula:

$$h(x)^3 = \frac{K}{b(x)}\left(\frac{a_0x^2}{2} + \frac{a_1x^3}{6} + \cdots + \frac{a_nx^{n+2}}{(n+1)(n+2)}\right)$$

16. The tool as claimed in claim 14, wherein the petals (27) have the shape of a truncated angular sector so that the width of the petal as a function of the distance x from the far end of the petal is expressed as:

$$b(x)=a_0+a_1x$$

so that at any distance x, a thickness of the petal is given by the formula:

$$h(x)^3 = \frac{K}{b(x)}\left(\frac{a_0x^2}{2} + \frac{a_1x^3}{6}\right)$$

17. An optical-grade surfacing tool (10), comprising:

a base (11) comprising a rigid holder (12) and a flexible collar (13) encircling said rigid holder (12), said rigid holder (12) having a transverse end surface (14), and said collar (13) having a transverse end surface (15) that is located on a same side as the transverse end surface (14) of the rigid holder (12);

an elastically compressible interface (16) comprising a first transverse end surface (17), a second transverse end surface (18), and a lateral surface (19) extending from a periphery of the first transverse end surface (17) to a periphery of the second transverse end surface (18), the first transverse end surface (17) of the elastically compressible interface (16) being attached to the transverse end surface (14) of the rigid holder (12) and to the transverse end surface (15) of the collar (13); and a flexible buffer (20) having a third transverse end surface (21) that is attached to the second transverse end surface (18) of the elastically compressible interface (16) and a fourth transverse end surface (22) that is configured to be applied against a surface (23) to be worked, said buffer (20) comprising a central portion (24) that is located plumb with the transverse end surface (14) of the rigid holder (12) and a peripheral portion (25) that is located transversely beyond the transverse end surface (14), said peripheral portion (25) being joined to the holder (12) exclusively by said interface (16) and by said collar (13), and said collar (13) being elastically deformable configured so that the tool (10) elastically deforms between a rest position in which the tool is free of any force applied for pressing the flexible buffer (22), and a reference position in which the second transverse end surface (22) of the flexible buffer (20) is pressed against a reference surface (37, 40, 46, 47) that is spherical with a radius ranging from 40 mm and 1500 mm, wherein the collar (13) is subdivided into petals (27), and wherein at every distance x from the far end of each petal (27), a thickness of the petal is smaller than:

$$h_{MAX} = \frac{R\sigma_{MAX}}{2E}$$

with $\sigma_{MAX}$ being a tensile limit of a material of the petals,

E being an elastic modulus of the material of the petals, and

R being an inverse of a difference in curvature between the rest position and the reference position of the tool.

* * * * *